US007663590B2

(12) United States Patent
Okazaki

(10) Patent No.: US 7,663,590 B2
(45) Date of Patent: Feb. 16, 2010

(54) FLICKER-CONSTRAINED LIQUID CRYSTAL DISPLAY

(75) Inventor: Susumu Okazaki, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 599 days.

(21) Appl. No.: 11/432,534

(22) Filed: May 12, 2006

(65) Prior Publication Data

US 2006/0256069 A1 Nov. 16, 2006

(30) Foreign Application Priority Data

May 16, 2005 (JP) ..... 2005-142947

(51) Int. Cl.
*G09G 3/36* (2006.01)

(52) U.S. Cl. ..... 345/96; 345/54; 345/209

(58) Field of Classification Search ..... 345/54, 345/96, 209

See application file for complete search history.

(56) References Cited

U.S. PATENT DOCUMENTS 6,674,421 B2 * 1/2004 Mori et al. ..... 345/96
6,873,311 B2 * 3/2005 Yoshihara et al. ..... 345/87
7,221,344 B2 * 5/2007 Shimomaki ..... 345/87
7,427,974 B2 * 9/2008 Asao et al. ..... 345/89
2005/0190138 A1 * 9/2005 Jung ..... 345/96

FOREIGN PATENT DOCUMENTS

JP 2000180820 A * 6/2000
JP 2004-219938 8/2004

* cited by examiner

*Primary Examiner*—Amare Mengistu
*Assistant Examiner*—Koosha Sharifi
(74) *Attorney, Agent, or Firm*—Harness, Dickey & Pierce P.L.C.

(57) ABSTRACT

A liquid crystal display has pixel electrodes, a common electrode, a liquid crystal layer provided between the pixel electrodes and the common electrode, and a back light that supplies light transmitting through the liquid crystal layer, further has a control circuit that applies a drive voltage corresponding to image data between the pixel electrodes and the common electrode such that the polarity of the drive voltage is inverted for each predetermined period. Within a frame period, the control circuit applies a drive voltage of a first polarity in a first period, applies a drive voltage of a second polarity opposite to the first polarity, which is the same voltage as the drive voltage of the first polarity, in a second period after the first period, and controls such that the back light is turned off in the first period and turned on in the second period.

3 Claims, 5 Drawing Sheets

SECOND EMBODIMENT

CONVENTIONAL EXAMPLE

FIRST EMBODIMENT

CONVENTIONAL EXAMPLE

SECOND EMBODIMENT

FLICKER-CONSTRAINED LIQUID CRYSTAL DISPLAY

CROSS-REFERENCE TO RELATED APPLICATIONS

This application is based upon and claims the benefit of priority from the prior Japanese Patent Application No. 2005-142947, filed on May 16, 2005, the entire contents of which are incorporated herein by reference.

BACKGROUND OF THE INVENTION

1. Field of the Invention

The present invention relates generally to a liquid crystal display, and, more particularly, to a liquid crystal display driven in a frame inversion mode, which constrains flickers associated with the frame inversion drive.

2. Description of the Related Art

A liquid crystal display is provided with a liquid crystal layer between a common electrode and pixel electrodes disposed on a matrix, applies a voltage corresponding to an image signal between both electrodes to change a transmission factor of the liquid crystal layer, and transmits light from a back light through the liquid crystal layer to perform gradation display. In this case, in order to prevent burn-in of a liquid crystal panel and deterioration of a liquid crystal material due to movement of ion components in the liquid crystal material toward one electrode through its long-time driving, the liquid crystal layer is driven by alternately inverting the polarity of the voltage applied to the liquid crystal layer. A mode inverting the polarity for each frame is referred to as a frame inversion mode, and a mode inverting the polarity for each line is referred to as a line inversion mode.

On the other hand, it is proposed to use a ferroelectric material as the liquid crystal material to enhance a response speed of the liquid crystal material to the applied voltage. For example, this is described in Japanese Patent Application Laid-Open Publication No. 2004-219938. In such a liquid crystal display, writing is performed by applying a voltage with only one polarity to the liquid crystal material; the back light is turned on in the state of holding the voltage after the writing; and subsequently, an inversion voltage is applied for erasing. Color display can be achieved through a field sequential color mode by displaying a RGB frame image in a time-sharing manner using RGB LED devices as the back-light light source without using a color filter.

SUMMARY OF THE INVENTION

In a conventional frame inversion mode, the polarity is inverted for each frame in the voltage applied between the pixel electrode and the common electrode. In this case, due to a field through voltage caused by driving a gate line, variations are generated in the voltage applied between the electrodes, which fluctuates the luminance values of the frames, and it is problematic that flickers become visible. A source voltage is applied to the pixel electrode while driving the gate line to H-level and by making a transistor, i.e., a switch element between a source line and the pixel electrode conductive, however, when the gate line is returned to L-level, the capacity coupling due to the capacity between the gate and source of the transistor fluctuates (reduces) the voltage of the pixel electrode connected to the source of the transistor. This is the field through voltage.

Due to the field through voltage, in a frame driven to the positive polarity, the voltage of the pixel electrode is reduced so as to reduce the voltage between the pixel electrode and the common electrode, and in a frame driven to the negative polarity, the voltage of the pixel electrode is reduced so as to increase the voltage between the pixel electrode and the common electrode. Therefore, the voltage of the common electrode must be adjusted such that the same inter-electrode voltages are generated in the frames of both polarities.

However, partially because variations exist in the field through voltage of each panel, the adjustment of the common electrode voltage to the appropriate level has limitations. Therefore, the flicker problem is left unsolved in the case of the frame inversion mode.

It is therefore the object of the present invention to provide a liquid crystal display that can constrain flickers.

In order to achieve the above object, according to a first aspect of the present invention there is provided a liquid crystal display having a plurality of pixel electrodes disposed on a matrix, a common electrode provided oppositely to the pixel electrodes, a liquid crystal layer provided between the pixel electrodes and the common electrode, and a back light that supplies light transmitting through the liquid crystal layer, the liquid crystal display comprising a control circuit that applies a drive voltage corresponding to image data between the pixel electrodes and the common electrode such that the polarity of the drive voltage is inverted for each predetermined period, wherein, within a frame period, the control circuit applies a drive voltage of a first polarity in a first period, applies a drive voltage of a second polarity opposite to the first polarity, which is the same voltage as the drive voltage of the first polarity, in a second period after the first period, and controls such that the back light is turned off in the first period and turned on in the second period.

According to the first aspect, since the back light is turned on in the second period when the drive voltage of the same polarity is applied between the electrodes in each frame, flickers caused by the field through voltage, etc. can be constrained. Since the liquid crystal layer is already driven in first period and the movement of the liquid crystal layer is established, the driving is achieved in the second period without response delay of the crystal layer and, therefore, it is suitable for the highly accurate gradation display to turn on the back light in the second period.

To achieve the above object, according to a second aspect of the present invention there is provided a liquid crystal display having a plurality of pixel electrodes disposed on a matrix, a common electrode provided oppositely to the pixel electrodes, a liquid crystal layer provided between the pixel electrodes and the common electrode, and a back light that supplies light transmitting through the liquid crystal layer, the liquid crystal display comprising a control circuit that performs drive between the pixel electrodes and the common electrode sequentially with drive voltages of a plurality of colors within a frame period, wherein, when performing the driving between the electrodes with the drive voltage of each color, the control circuit applies a drive voltage of a first polarity in a first period, applies a drive voltage of a second polarity opposite to the first polarity, which is the same voltage as the drive voltage of the first polarity, in a second period after the first period, and controls such that the back light is turned off in the first period and turned on in the second period.

According to the second aspect, in the field sequential color display mode that sequentially drives the liquid crystal layer with the drive voltages for a plurality of colors to enable the color display, the drive voltage of the first polarity is applied in the first period of the drive period of each color; the drive voltage of the reverse polarity is applied in the subsequent second period; the back light is turned on in the second period and turned off in the first period; and therefore, the drive voltage during turning on the back light is the same in each frame, which can constrain the generation of the flickers due to the inverse drive of the crystal layer.

In the first and second inventions, a preferred aspect includes a plurality of gate lines, a plurality of source lines intersecting therewith, and a switch provided between the source line and the pixel electrode and controlled by the gate line, and in the second period, the plurality of gate lines are scanned sequentially to apply the drive voltage to the pixel electrode from the source line. Since the writing is performed in the second period, although a state of applying the drive voltage of the first polarity and a state of applying the drive voltage of the second polarity are illuminated by the backlight at the pixel electrode of the gate line of the lower end portion, the same state is always illuminated among frames and therefore, the flickers are constrained. Flickers are constrained by inversely driving a liquid crystal layer.

BRIEF DESCRIPTION OF THE DRAWINGS

The above and other objects, aspects, features and advantages of the present invention will become more apparent from the following detailed description when taken in conjunction with the accompanying drawings, in which.

DESCRIPTION OF THE PREFERRED EMBODIMENTS

Description will hereinafter be made of embodiments of the present invention with reference to drawings. However, the technical scope of the present invention is not limited to these embodiments and covers contents described in claims and equivalents thereof.

Figure 1:
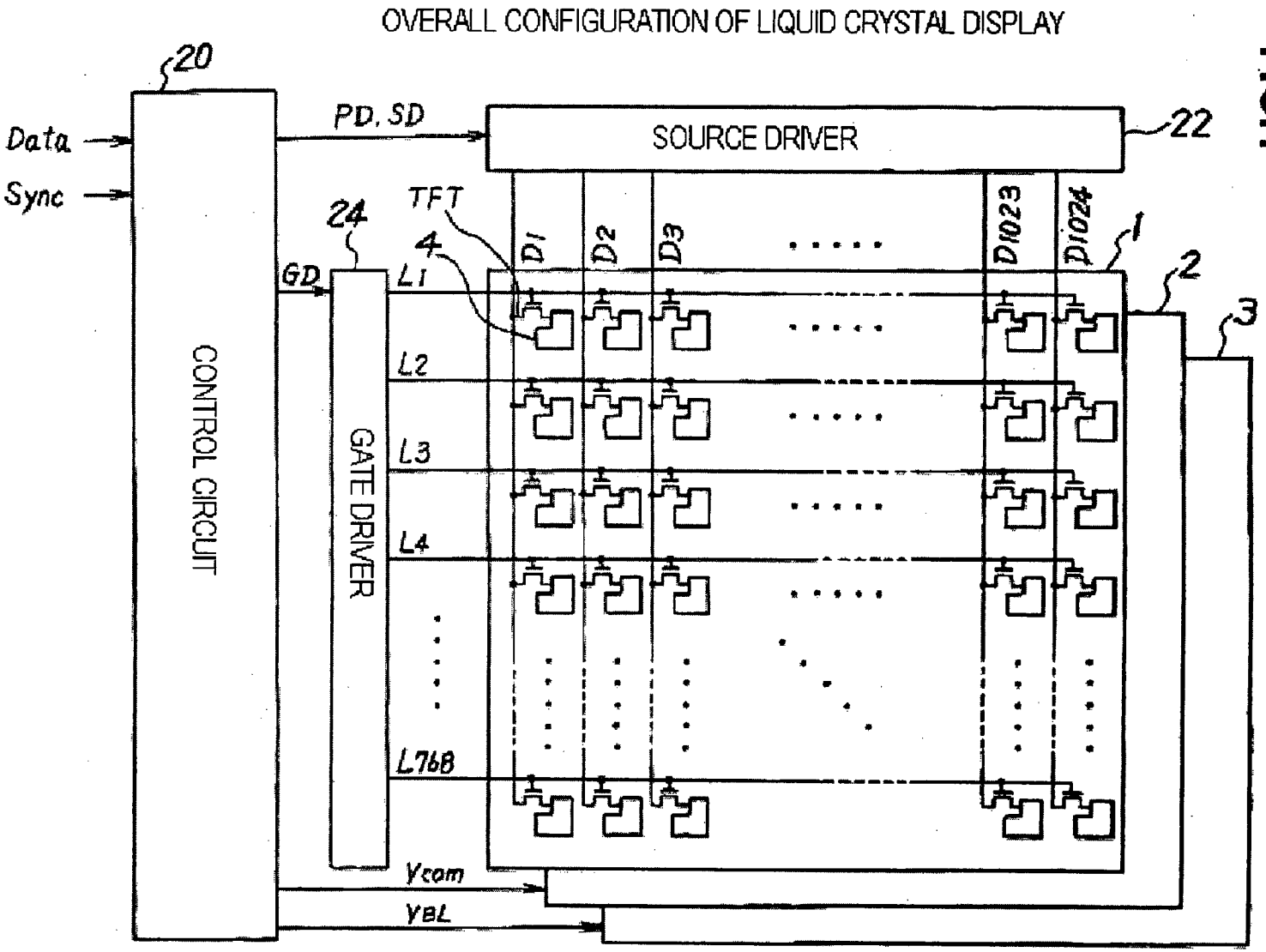
FIG. 1 is an overall configuration diagram of a liquid crystal display according to the embodiment.

FIG. 1 is an overall configuration diagram of a liquid crystal display according to the embodiment. A liquid crystal display panel is constituted by a plurality of source lines D1 to D1024, gate lines L1 to L768 intersecting therewith, a first substrate 1 where thin-film transistors TFT for switches disposed at the intersecting positions and pixel electrodes 4 are formed, and a second substrate 2 where a common electrode is disposed, a back light 3, and a liquid crystal layer (not shown) provided between the pixel electrodes 4 and the common electrode (not shown). Polarizing plates (not shown) are provided on both sides of the substrates 1, 2, and the light from the back light 3 is transmitted through the polarizing plate, is turned in the deflecting direction, and passes through another polarizing plate when the light from the back light is transmitted. The direction and inclination of liquid crystal molecules are changed depending on the voltage applied to the liquid crystal layer to control the turning of the transmitted light and thereby the transmission factor thereof is controlled. In this way, the gradation control is performed for each pixel.

The control circuit 20 inputs display data Data and a synchronizing signal Sync and controls driving of a source driver 22 and a gate driver 24. The gate driver 24 drives the gate lines L1 to L768 sequentially depending on a gate drive signal to make the transistor TFT of each pixel conductive. On the other hand, the source driver 22 applies a source voltage corresponding to image data PD to each source line D1 to D1024 depending on the image data PD and a source drive signal SD in synchronization with the drive of the gate lines. The control circuit 20 performs the drive control by a voltage Vcom of the common electrode and the lighting control by a voltage VBL of the back light 3. In this way, a drive voltage is applied between each pixel electrode and the common electrode correspondingly to the image data.

Figure 2:
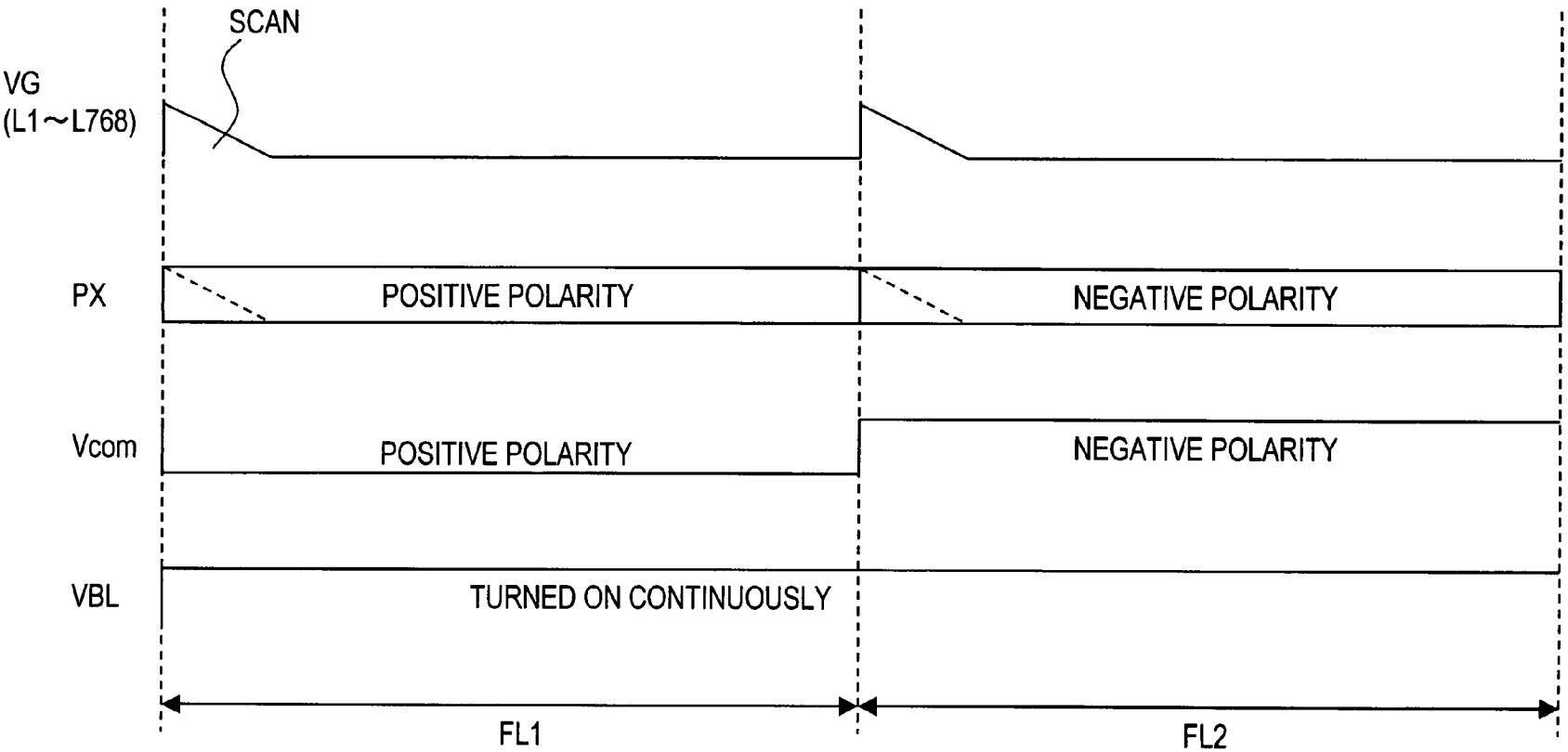
FIG. 2 shows panel drive in a conventional frame inversion mode.

FIG. 2 shows panel drive in a conventional frame inversion mode. FIG. 2 shows the gate driver's drive VG, a pixel application state PX, a common electrode voltage Vcom, and a backlight voltage VBL. In an initial period of a first frame period FL1, the gate driver 24 sequentially drives and scans the gate lines L1 to L768. A triangular wave portion of VG of FIG. 2 shows the scanning drive. The source driver 22 applies a positive-polarity source voltage to each source line D1 to D1024 and the control circuit 20 drives the common electrode with a positive-polarity voltage Vcom at the same time. In this way, each pixel electrode PX is driven sequentially with the positive-polarity voltage (a dotted line of FIG. 2) and maintains this state for the rest of the first frame period L1.

In a second frame period FL 2 subsequent to the first frame period FL1, the gate driver 24 sequentially drives and scans the gate lines in the same way and, at the same time, the source driver 22 applies a negative-polarity source voltage to each source line and the common electrode is driven with a negative-polarity voltage Vcom. In this way, each pixel electrode PX is driven sequentially with the negative-polarity voltage (a dotted line of FIG. 2) and maintains this state for the rest of the second frame period L2. The positive-polarity source voltage is a voltage higher than the L-level common electrode voltage Vcom, and the negative-polarity source voltage is a voltage lower than the H-level common electrode voltage Vcom. In this way, although the polarity is inverted in each frame, if the image data are the same in the frame periods FL1, FL2, the voltage values between the pixel electrode and the common electrode are equivalent.

In the conventional frame inversion mode, the back light is continuously turned on. Therefore, in the first frame period FL1, the gradation display is performed in the state of driving the liquid crystal molecules with the positive polarity and, in the second frame period FL2, the gradation display is performed in the state of driving the liquid crystal molecules with the negative polarity. Therefore, when the same gradation display is continued for a plurality of frames, the positive-polarity frame and the negative-polarity frame may have different gradation values, which cause flickers.

Figure 3:
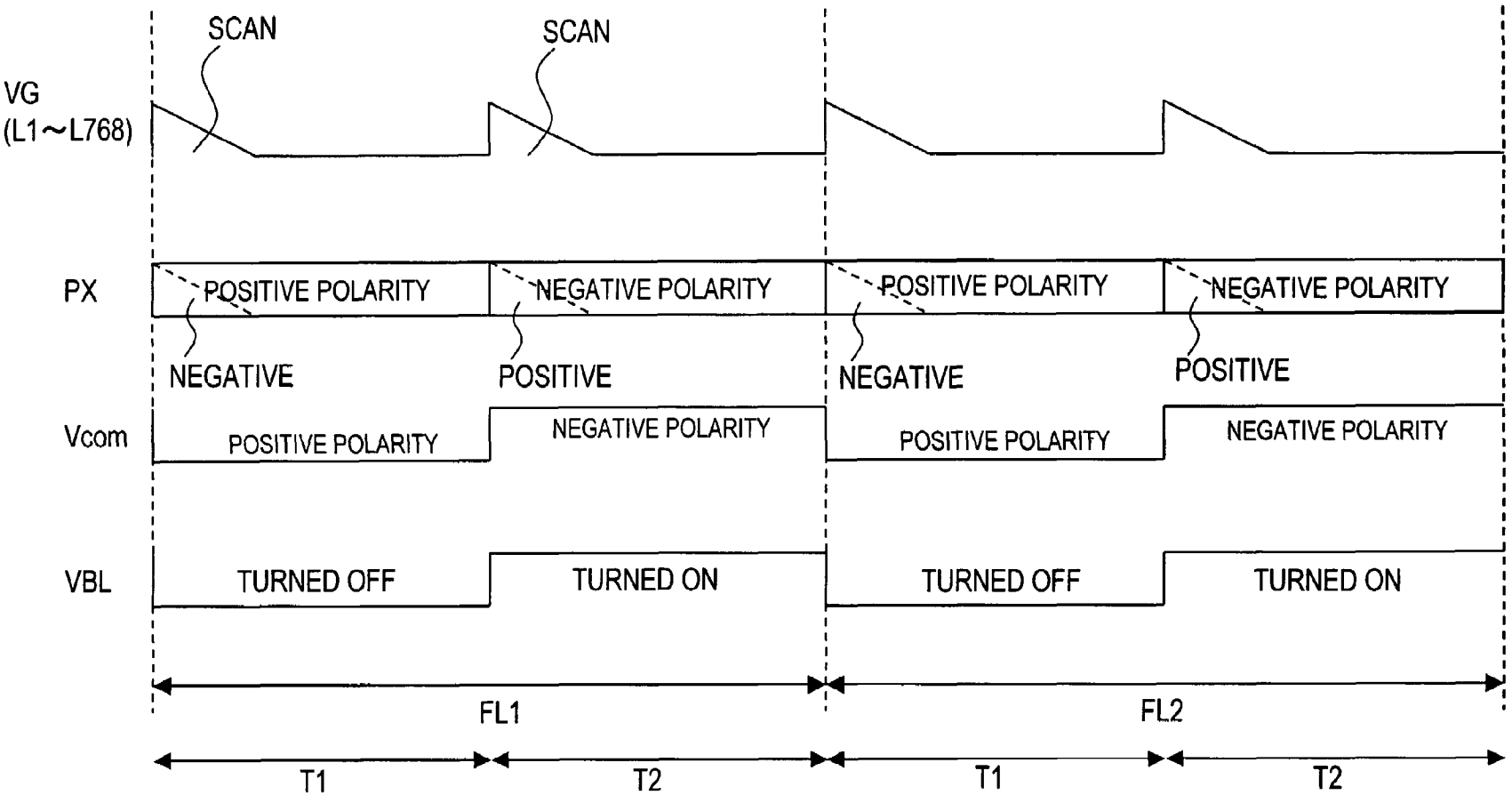
FIG. 3 shows panel drive according to a first embodiment.

FIG. 3 shows panel drive according to the first embodiment. FIG. 3 shows the gate driver's drive VG, the pixel application state PX, the common electrode voltage Vcom, and the backlight voltage VBL as is the case with FIG. 2. In a first half period T1 of each frame period FL1, FL2, the control circuit applies a positive-polarity voltage to the pixel electrodes (see pixel PX), and applies a positive-polarity voltage Vcom to the common electrode, so as to apply a positive-polarity voltage to the liquid crystal layer. In the first period T1, the back light is turned off. In the second half period T2, the control circuit applies a negative-polarity voltage to the pixel electrodes (see pixel PX), and applies a negative-polarity voltage Vcom to the common electrode, so as to apply a negative-polarity voltage to the liquid crystal layer. In the second period T2, the back light is turned on. At the beginning of each period T1, T2, the gate driver sequentially drives and scans the gate lines L1 to L768 (see a triangular wave of VG in FIG. 3); the transistor TFT of each pixel is made conductive; and the applied voltage of each pixel is changed from a voltage of one polarity to a voltage of the next polarity.

As shown in FIG. 3, in each frame period FL1, FL2, the control circuit applies the positive-polarity voltage to the liquid crystal layer while sequentially scanning the gate lines in the first period T1 with the back light turned off. The liquid crystal molecules in the liquid crystal layer are moved to positions corresponding to the applied voltage with predetermined delay characteristics. The control circuit then applies the negative-polarity voltage to the liquid crystal layer while sequentially scanning the gate lines in the second period T2 with the back light turned on. Since the voltage applied to the liquid crystal layer is the same as the voltage before the inversion of the polarity, only the positive charge and the negative charge are simply switched in a dielectric material composed of the liquid crystal layer without changing the positions of the liquid crystal molecules, which are dependent on the applied voltage. Therefore, the liquid crystal molecules have almost no delay characteristics in the second period T2. The back light is turned on to perform the gradation display only in the second period T2 of each frame period. Since the negative-polarity voltage is applied to the liquid crystal layer of the pixels in the second period T2 of each frame, when the same gradation state is maintained between frames, the displayed gradation value is held constant and the generation of the flickers is constrained.

In the first embodiment of FIG. 3, the gate lines L1 to L768 are scanned and image data are written into each pixel at the beginning of the second period T2. Therefore, on the gate line L1, which is scanned first, all pixels are driven to the negative polarity during when the back light is turned on. On the other hand, on the gate line L768, which is scanned last, pixels are initially driven to the positive polarity and then driven to the negative polarity during when the back light is turned on. However, since the same state is maintained (the positive-polarity drive and the negative-polarity drive are mixed) for the frame L1 and L2, the flicker is constrained between the frames.

In this way, in the first embodiment, instead of the frame inversion drive that inverts the polarity of the drive voltage for each frame, the polarity of the drive voltage is inverted within the frame period. That is, the pixels are driven with a first polarity in the first half of frame periods FL1, FL2; the pixels are driven by the same voltage with a second polarity that is an inverse polarity of the first polarity in the second half of frame periods FL1, FL2; and the back light is turned on only in the period of driving with the second polarity. The negative-polarity drive may be performed in the first half period T1 of the frame period and the positive-polarity drive may be performed in the second half period T2. In this case, the back light is controlled to be turned on in the positive-polarity drive period T2. If sufficient time can be utilized and sufficient luminance can be obtained, the back light may be turned on during the second period T2 except the gate line scanning period.

Figure 4:
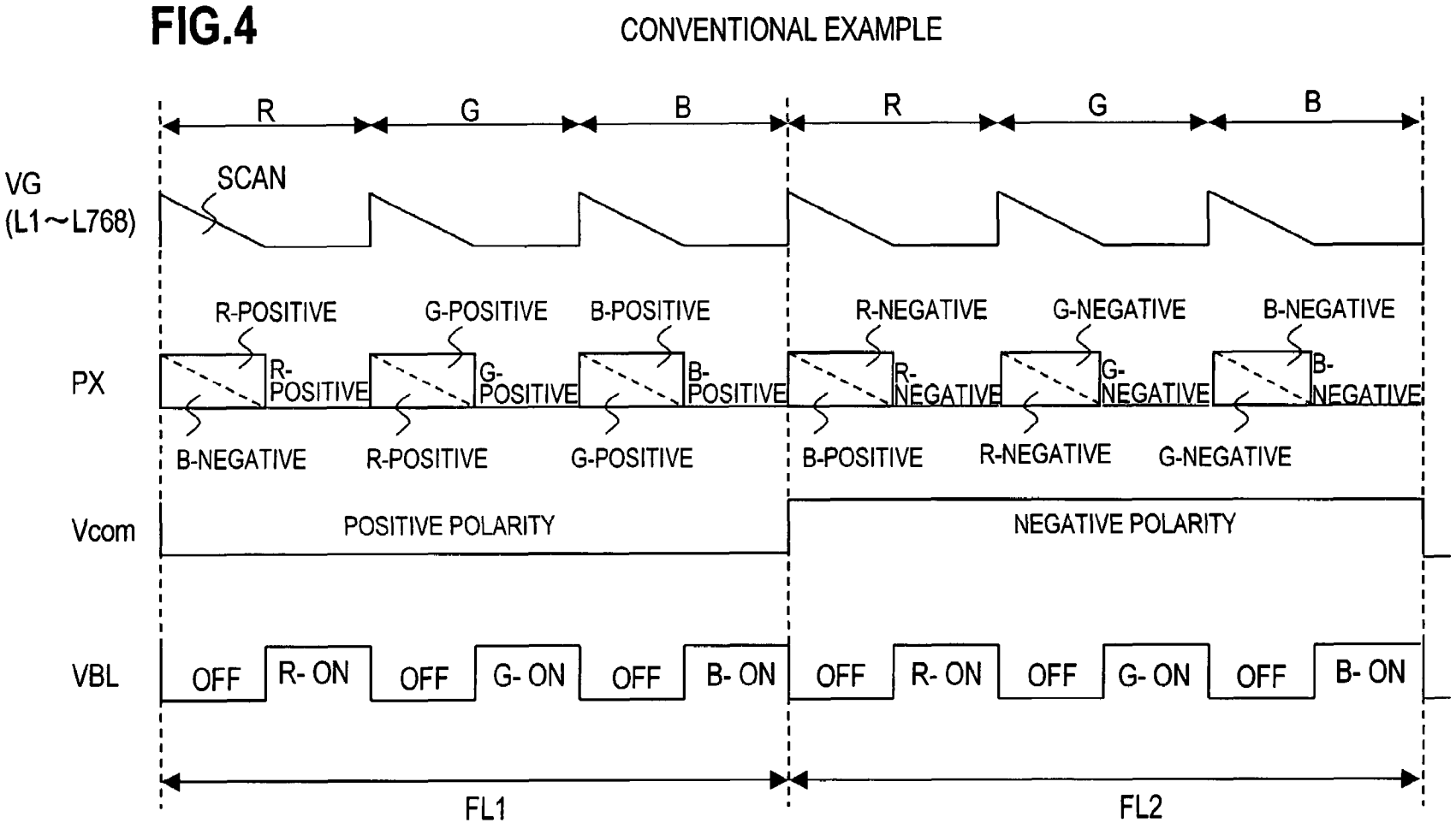
FIG. 4 shows drive of a liquid crystal display in a conventional field sequential mode.

FIG. 4 shows drive of a liquid crystal display in a conventional field sequential mode. In the field sequential mode, each frame FL1, FL2 is divided into periods for displaying planes of three primary colors R (red), G (green), and B (blue); in the R-period, the gate lines are scanned to display an image of the R-plane on the panel; in the next G-period, the gate lines are scanned to display an image of the G-plane on the panel; and finally, in the B-period, the gate lines are scanned to display an image of the B-plane on the panel. Since the color state of the previous period is mixed with the color state of the current period while scanning the gate lines in each period R, G, B, the back light is turned off during the scanning and the back light of the corresponding color is turned on in a data holding period after the scanning to prevent the mixture of the displayed colors. That is, the back lights are provided in three colors, the back light of the corresponding color is turned on in each period R, G, B, and the display of three colors is performed within one frame period in a time-sharing manner. In the frame FL1, the positive-polarity voltage is applied to each pixel and the common electrode, and in the next frame FL2, the negative-polarity voltage is applied to each pixel and the common electrode to perform the frame inversion drive.

In the case of the field sequential mode, since the polarity of the applied voltage is inverted for each frame when using the frame inversion mode, if the same gradation is displayed continuously, the displayed gradation value is fluctuated because the polarity is varied in each frame, which causes flickers.

Figure 5:
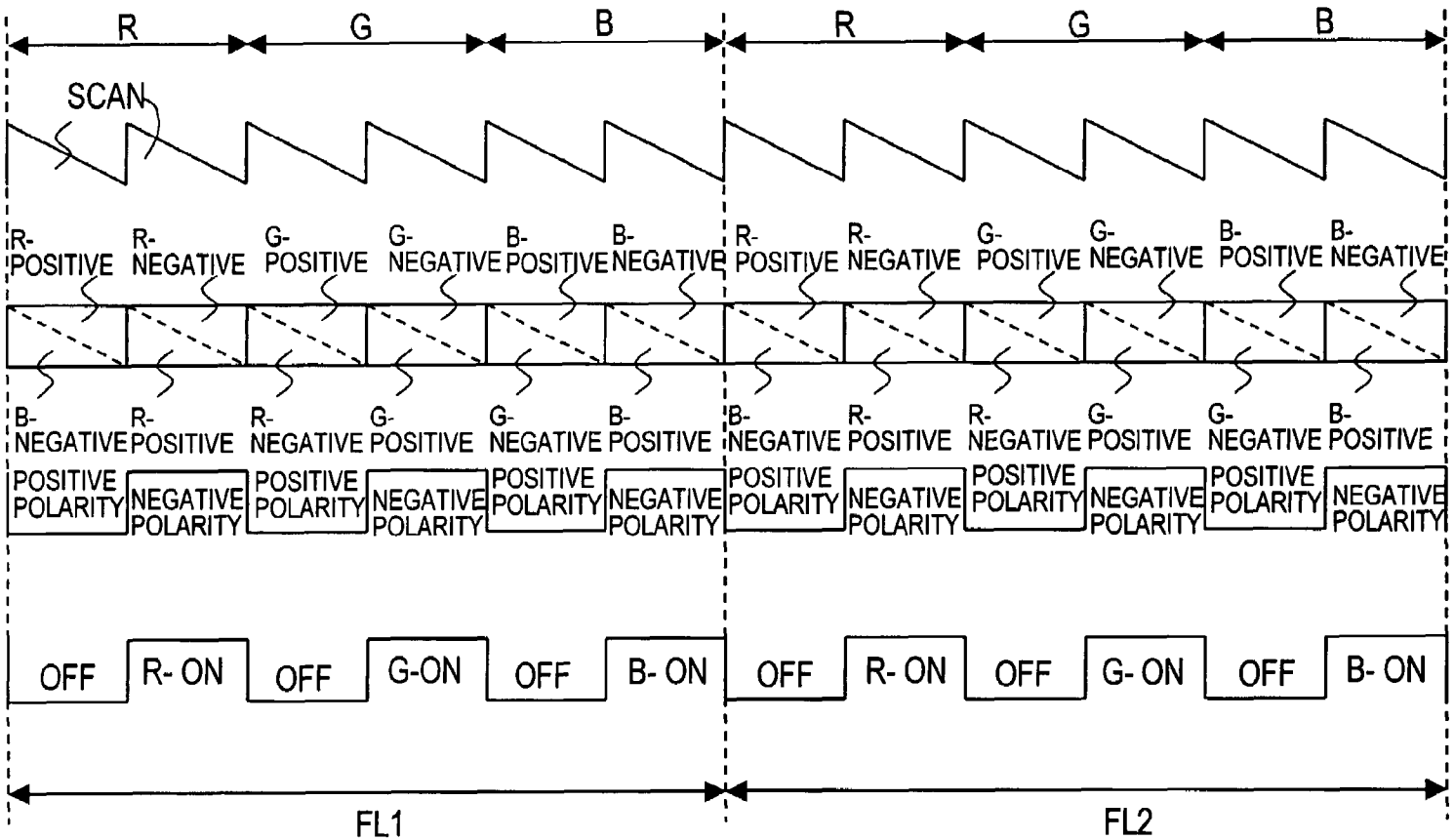
FIG. 5 shows panel drive in the field sequential mode according to a second embodiment.

FIG. 5 shows panel drive in the field sequential mode according to a second embodiment. In the second embodiment, each of the frame periods FL1, FL2 is divided into three drive and display periods of R, G, and B. However, in the second embodiment, the frame inversion drive is not performed and the inversion drive of the pixels is performed in each drive and display period of R, G, and B.

In the frame period FL1, the gate electrodes are scanned to change all the pixels from the drive state of the negative-polarity voltage of B to the drive state of the positive-polarity voltage of R in the first half of an initial period R, and the gate electrodes are scanned again to change all the pixels to the drive state of the negative-polarity voltage of R in the second half of the initial period R. Accordingly, the voltage Vcom of the common electrode is switched between the positive polarity and the negative polarity. The back light is turned off in the first half of the period R and the back light is turned on in the second half of the period R. Therefore, the R-plane image is displayed in the second half of the period R. In the second half, the back light is turned on when some pixels scanned first are in the drive state of the negative-polarity voltage, and the back light is turned on when some pixels scanned last are in the drive state of the positive-polarity voltage; and the back light is turned on when the rest of the pixels are in the mixed drive state of the positive-polarity and negative-polarity voltages.

Although the polarity of voltage applied to the liquid crystal molecules of each pixel is inverted by the pixel electrode drive and the common electrode drive associated with the gate line scanning in the second half of the period R, since the liquid crystal molecules have been already driven in the first half by the same voltage that is simply inverted in the polarity, the liquid crystal molecules are not moved and only the electric charge thereof is inverted. Therefore, the liquid crystal molecules have no delay motion due to the polarity inversion.

In the next period G of the frame period FL1, as is the case with the period R, the gate electrodes are scanned to change all the pixels from the drive state of the negative-polarity voltage of R to the drive state of the positive-polarity voltage of G in the first half, and the gate electrodes are scanned again to change all the pixels to the drive state of the negative-polarity voltage of G in the second half of the period G. Accordingly, the voltage Vcom of the common electrode is switched between the positive polarity and the negative polarity. The back light is turned off in the first half of the period G and the back light is turned on in the second half of the period G. Therefore, the G-plane image is displayed in the second half of the period G. A subsequent period B is the same as the above description.

In the next frame period FL2, the gate lines, the source lines, the pixel electrodes, and the common electrode are driven and the RGB back lights are turned on as is the case with the frame period FL1. That is, the frame inversion mode is not employed; the same voltage polarity is applied to the pixels in the periods R, G, and B within each frame period; and in the example of FIG. 5, in each period R, G, and B, the back light of each color is turned on only in the period when the drive state of the positive-polarity voltage is inverted to the drive state of the negative-polarity voltage. Therefore, since the display states are always the same for the same pixel among the frames when the back light is turned on, if the same luminance display is continued, the luminance is not varied among frames and the flickers can be constrained.

As shown in the gate electrode VG of FIG. 5, all the gate lines are scanned in the first half periods of the periods R, G, and B, and all the gate lines are also scanned in the second half periods. However, if the scanning rate is faster and sufficient time can be utilized, the second half periods of the periods R, G, and B may be provided with the scanning periods of all the gate lines and retention periods for retaining the states thereof. The positive polarity and the negative polarity may be reversed as is the case with the first embodiment. In such a case, the back lights are turned off in the first half periods of the periods R, G, and B, and the back light of the corresponding color is turned on in the second half periods of the periods R, G, and B.

In the second embodiment, since the voltage applied states of different colors are mixed in the first half of each period R, G, and B, the back lights are turned off in the first half, and since the voltage applied state of the same color is maintained in the second half (although the polarity is different), the back light of that color is turned on in the second half. The proportion of the lighting of the back light is the same as the conventional example of FIG. 4, and the rate of the lighting is not reduced.

As described above, in the field sequential mode, the generation of flickers can be constrained while preventing the deterioration of the liquid crystal material by performing the polarity inversion drive in the drive period of each color.

According to the present invention there can be provided a liquid crystal display that constrain the generation of flickers associated with the voltage drive in both positive and negative polarities.

What is claimed is:

1. A liquid crystal display comprising:

a plurality of gate lines;

a plurality of source lines intersecting with the plurality of gate lines;

a plurality of pixel electrodes disposed on a matrix;

a switch provided between a source line and a pixel electrode and controlled by a gate line;

a common electrode provided opposite to the plurality of pixel electrodes;

a liquid crystal layer provided between the plurality of pixel electrodes and the common electrode;

a back light configured to supply light transmitted through the liquid crystal layer; and a control circuit configured to perform drive between the plurality of pixel electrodes and the common electrode sequentially with drive voltages of a plurality of colors within a frame period, wherein when performing the drive between the plurality of pixel electrodes with a drive voltage of each color, the control circuit applies a drive voltage of a first polarity in a first period, applies a drive voltage of a second polarity opposite to the first polarity in a second period after the first period, and controls the back light to be turned off in the first period and turned on in the second period, wherein the control circuit sequentially scans the plurality of the gate lines to apply the drive voltage of the first polarity from the plurality of source lines to the plurality of pixel electrodes in the first period and sequentially scans the plurality of the gate lines to apply the drive voltage of the second polarity from the plurality of source lines to the plurality of pixel electrodes in the second period.

2. The liquid crystal display of claim 1, wherein when performing the drive between the electrodes with the drive voltage of each color, the control circuit turns on the back light in the second period using the back light of the corresponding color.

3. The liquid crystal display of claim 1, wherein when performing the drive between the electrodes with the drive voltage of each color, the control circuit turns on the back light in the second period using the back light of the corresponding color.

* * * * *